United States Patent [19]

Diffrient

[11] Patent Number: 4,827,851

[45] Date of Patent: May 9, 1989

[54] TABLE WITH FOLDING LEG

[75] Inventor: Niels Diffrient, Ridgefield, Conn.

[73] Assignee: Howe Furniture Corporation, Trumbull, Conn.

[21] Appl. No.: 181,722

[22] Filed: Apr. 14, 1988

[51] Int. Cl.[4] ..... A47B 3/00

[52] U.S. Cl. ..... 108/132; 248/188.6

[58] Field of Search ..... 108/132, 133, 131, 129, 108/130; 248/188, 188.1, 188.6, 439, 440, 440.1, 166

[56] References Cited

U.S. PATENT DOCUMENTS

| | | | |
|---|---|---|---|
| 1,203,783 | 11/1916 | Reischmann | 108/132 |
| 2,318,945 | 5/1943 | Johannsen | 108/133 |
| 2,343,537 | 3/1944 | De Saussure | 108/132 |
| 2,801,143 | 7/1957 | Mendenhall | 108/132 |
| 2,860,940 | 11/1958 | De Saussure | 108/133 |
| 3,267,886 | 8/1966 | Glass | 108/132 X |
| 3,606,846 | 9/1971 | Andrews et al. | 108/132 |
| 3,695,567 | 10/1972 | Weagle | 248/188.6 |
| 4,191,111 | 3/1980 | Emmert | 108/132 |
| 4,597,553 | 7/1986 | Ronabaugh | 248/188.6 X |
| 4,759,296 | 7/1988 | Simpson | 108/132 X |

*Primary Examiner*—Kenneth J. Dorner
*Assistant Examiner*—José V. Chen
*Attorney, Agent, or Firm*—Parmelee, Bollinger & Bramblett

[57] ABSTRACT

The invention is an improved leg folding mechanism for a folding table. The leg has a T-shaped top end and carries a pair of disc shaped followers on the ends of the T arms. These followers are arranged to travel in a pair of parallel guide channels when the leg is folded and erected. The leg itself carries an "axle" which protrudes therethrough on both sides. Each of a pair of elongated compression members is connected at one end to one end of the axle and the other end of each compression member is pivotally connected to the table top. Each of a pair of tension links is also pivotally connected to the table top at one end and to the axle by a slot in the other end. A latch secures the top end of the leg to the table top when erected. The dimensions of the compression members and tension links are so selected that, when the table is erected, the tension links are under tension and this tension force is applied directly to the compression members, thereby keeping them under compression. This results in a table of exceptional rigidity.

13 Claims, 4 Drawing Sheets

TABLE WITH FOLDING LEG

TECHNICAL FIELD

This invention pertains to the field of leg-folding mechanisms for tables. More particularly, it pertains to such mechanisms having less slack and more rigidity than prior art mechanisms.

BACKGROUND ART

Tables with folding legs are, of course, well known in the art. There has been a continuing effort to provide such tables which, when erected, have the rigidity of conventional tables. One way of achieving increased rigidity is to reduce the number of the folding legs to two by making them in an inverted "T" shape, thereby reducing the number of folding mechanisms required.

Another method for increasing the rigidity of such a table is to utilize a trestle bar which connects the two legs. An example of such a construction may be found in U.S. Pat. No. 4,444,124 of Burr, which issued Apr. 24, 1984 and was assigned to the same assignee as the present invention.

An earlier such patent is U.S. Pat. No. 3,818,844 which issued June 25, 1974. The table described in that patent includes a trestle bar connecting the two table legs and a stretcher bar extending in the same general direction as the trestle bar. Pins project outwardly from both ends of the stretcher bar. Means are provided to enable each table leg to be unfolded through an arc of more than 90° relative to the underside of the table top. The stretcher bar is rotatable to align the pins projecting from its ends with suitable openings in the top of the table legs. The pins are insertable into the openings and lock the table legs in their unfolded, or "erected" position. Folding the table legs is accomplished by reversing the above steps.

DISCLOSURE OF INVENTION

The present invention comprises a foldable table leg of the inverted T type having a folding mechanism attaching it to the table top. The leg is operable between a folded horizontal position lying against the underside of the table top and an unfolded, erected, position. The erecting mechanism for each leg includes a pair of compression members connected to, and straddling, the leg and a pair of similarly arranged tension members. They are so connected that when the table is erected, each compression member is in compression and opposes its corresponding tension member, thereby placing it in tension. The compression and tension forces act through a pin in the table leg while the upper end of the table leg is locked into position at the table top. By means of this arrangement, a high degree of rigidity is achieved without requiring a trestle bar. During folding and unfolding, the leg motion is controlled by a pair of guides on the leg assembly which travel along a pair of tracks on the underside of the table top. In addition, a pair of adjustable pressure bearings are provided for taking up any slack that might arise in the mechanism as a result of use over a period of time.

BRIEF DESCRIPTION OF DRAWINGS

The invention will be described, by way of example, with reference to the following drawings.

BEST MODE FOR CARRYING OUT THE INVENTION

Figure 1:
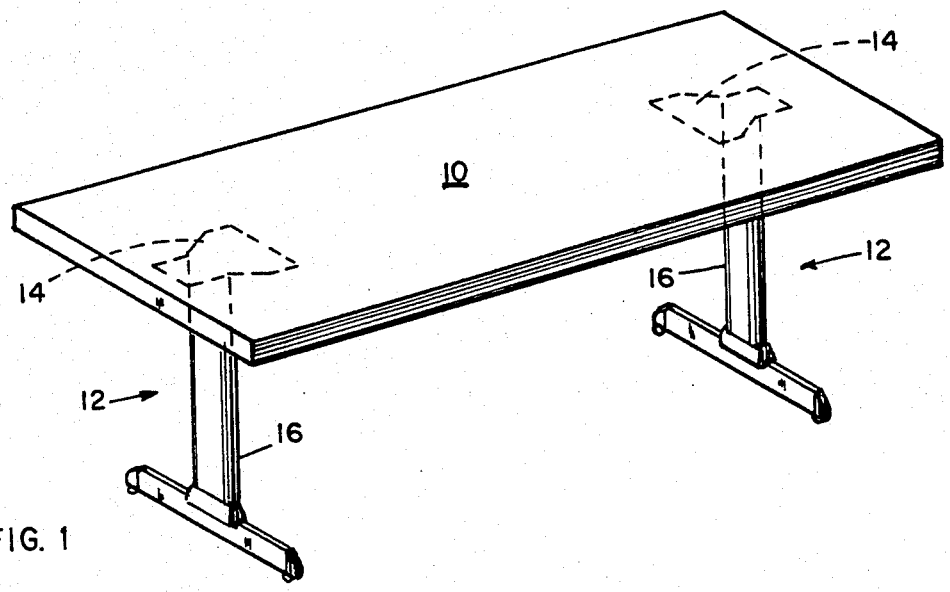
FIG. 1 is a perspective view of an erected folding table incorporating the invention.

FIG. 1. illustrates a table in accordance with the present invention comprising a top 10 to which are secured a pair of identical table leg assemblies 12. Each of the leg assemblies 12 comprises a steel plate or chassis 14 which is secured to the table top and carries a folding mechanism from which depends an inverted T shaped leg 16. The folding mechanism is illustrated in FIGS. 2–4.

Figure 2:
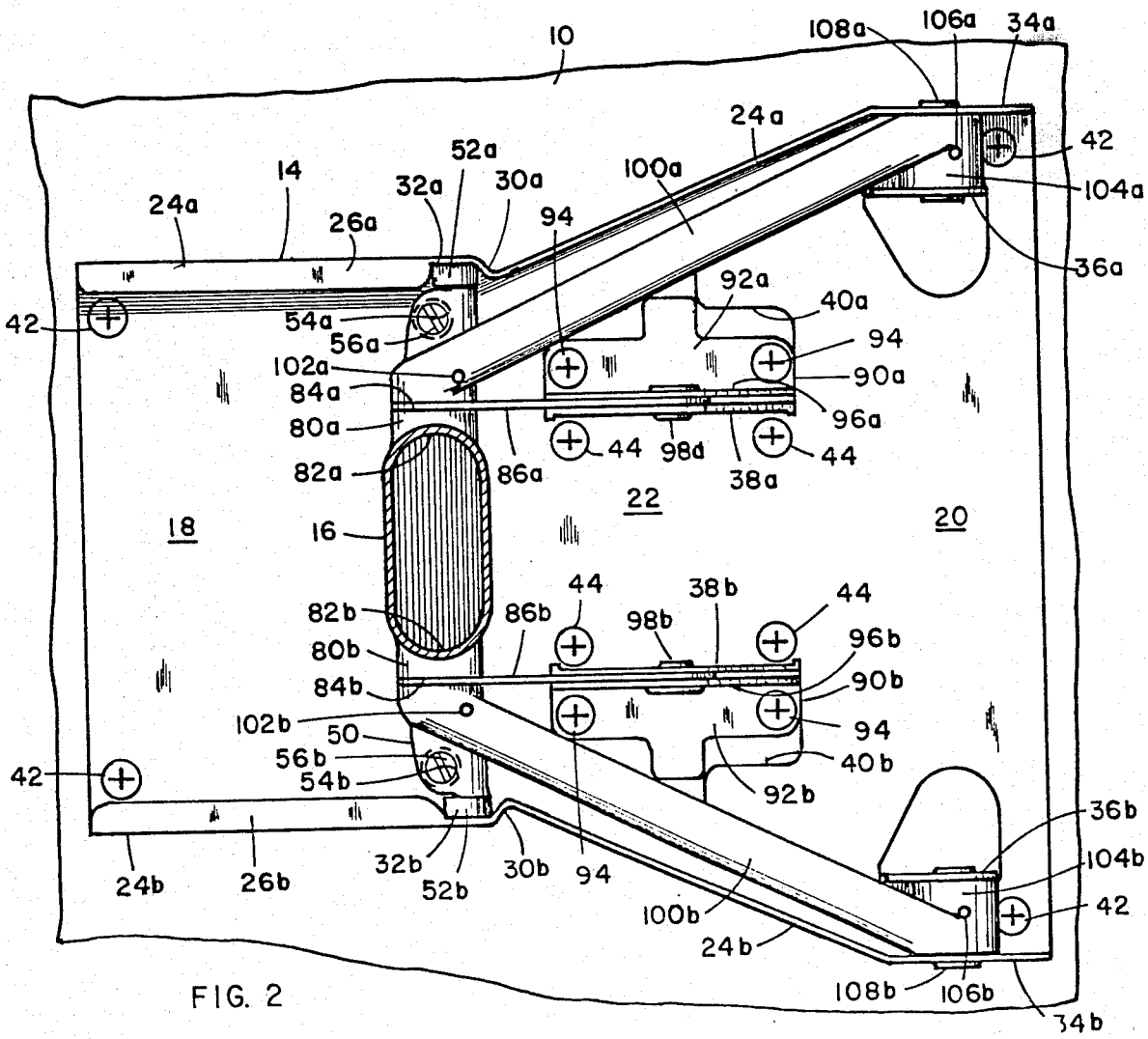
FIG. 2 is a bottom view of one of the leg folding mechanisms of the table of FIG. 1 in its erected condition, taken through the vertical leg.

FIG. 2. illustrates the folding mechanism as viewed from the bottom on a section through the hollow, oval-shaped leg 16. The chassis 14 will be seen to include a relatively narrow rectangular portion 18, a relatively wide rectangular portion 20, and a central triangular section 22 connecting the two. The chassis is positioned on the table top with the narrow rectangular portion 18 toward the table end and the wide rectangular portion 20 toward the table center. The side edges of the chassis 14 are bent downwardly from the table top to form sidewalls 24*a*, 24*b*. Those portions of the sidewalls 24*a,b* along the narrow rectangular portion 18 of the chassis 14 are left wider over most of their length. A lip 26*a,b* is bent inwardly along each of these sidewall portions to define a pair of parallel guide channels 28*a,b* which can be seen most clearly in FIG. 4.

As will be clear from FIG. 2, the narrow end of the triangular portion 22 of the chassis 14 is slightly narrower than the narrow rectangular portion 18 so that the sidewall 4*a,b* at this juncture forms a stop 30*a,b*. Also, the lips 26*a,b* are slightly shorter than the width of the narrow rectangular portion 18 so as to leave recesses 32*a,b* adjacent to each of the stops.

Figure 3:
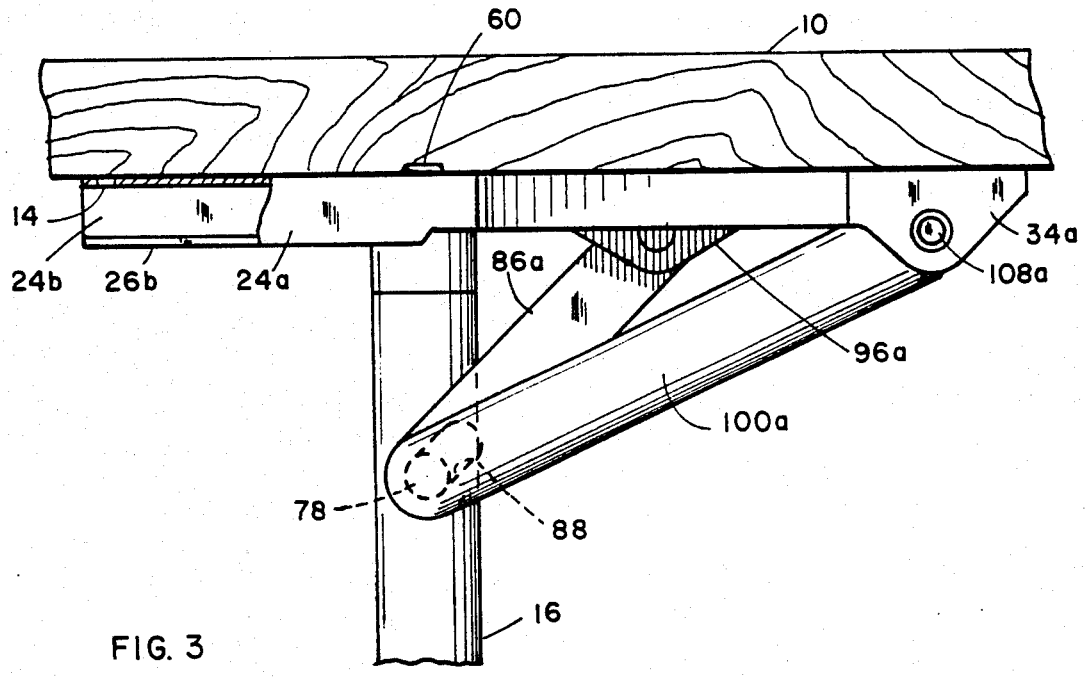
FIG. 3 is an elevational view of the leg folding mechanism of FIG. 2.
Figure 4:
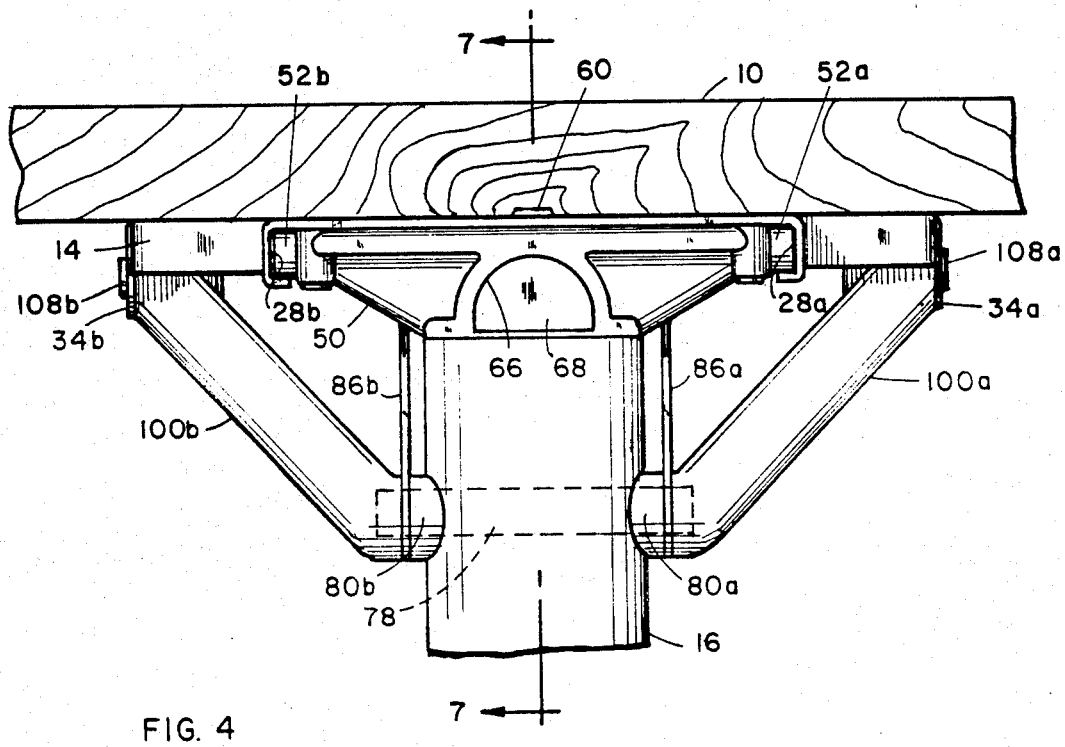
FIG. 4 is a left end view of the leg folding mechanism of FIG. 3.

At the wide end of the chassis 14 the sidewalls 24*a,b* are somewhat wider and are shaped into compression pivot brackets 34*a,b*, most easily seen in FIG. 3. The wide rectangular portion 20 of the chassis 14 is pierced near its outer corners to form tabs which are bent upward to form inside pivot tabs 36*a,b* which are spaced from, and parallel to, respective ones of the compression pivot brackets 34*a,b*. The chassis 14 is also pierced and bent within the triangular section 22 to form tension pivot tabs 38*a,b* while leaving cutout openings 40*a,b*.

The chassis 14 is secured to the underside of the table top 10 by screws 42 at its four corners and by two pairs of inner screws 44. Each pair of the inner screws 44 is positioned in the triangular portion 22 of the chassis adjacent one of the tension pivot tabs 38*a,b*. The chassis plate 14 includes a locking hole 46 therethrough (FIG. 7), centrally positioned between the recesses 32*a*, 32*b*. The chassis 14 is also deformed to create short, parallel locating ridge pairs 48 which are shown in detail in FIGS. 5 and 6. Each ridge pair is located closely adjacent one of the recesses 32*a,b*.

The upper end of the hollow tubular leg 16 terminates in a die cast aluminum leg top 50. Leg top 50 is elongated and carries at each end a circular cup-shaped, plastic cap 52*a,b*. When the table is erected, these caps are positioned as shown in FIG. 2, each within its corresponding recess 32*a,b* and against its corresponding stop 30*a,b*.

Figure 5:
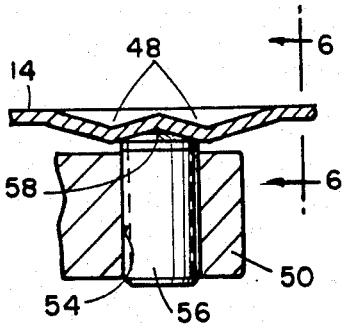
FIG. 5 is an enlarged cross-sectional detail showing the positioning ridges and adjustable pressure bearing feature of the invention
Figure 6:
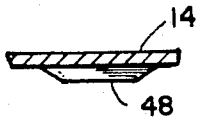
FIG. 6 is a cross-section, taken substantially along the line 6—6 of FIG. 5, with the pressure bearing omitted.

Closely adjacent each of the plastic caps 52*a,b* is a tapped opening 54*a,b* which extends through each end of the leg top 50. Threaded within each of these tapped openings is a respective pressure bearing 56*a,b* having a screw adjusting slot easily reachable from the underside of the table and carrying an elastomeric button 58 which is engaged by a pair of locating ridges 48 when the table is erected (FIGS. 5 and 6).

Figure 7:
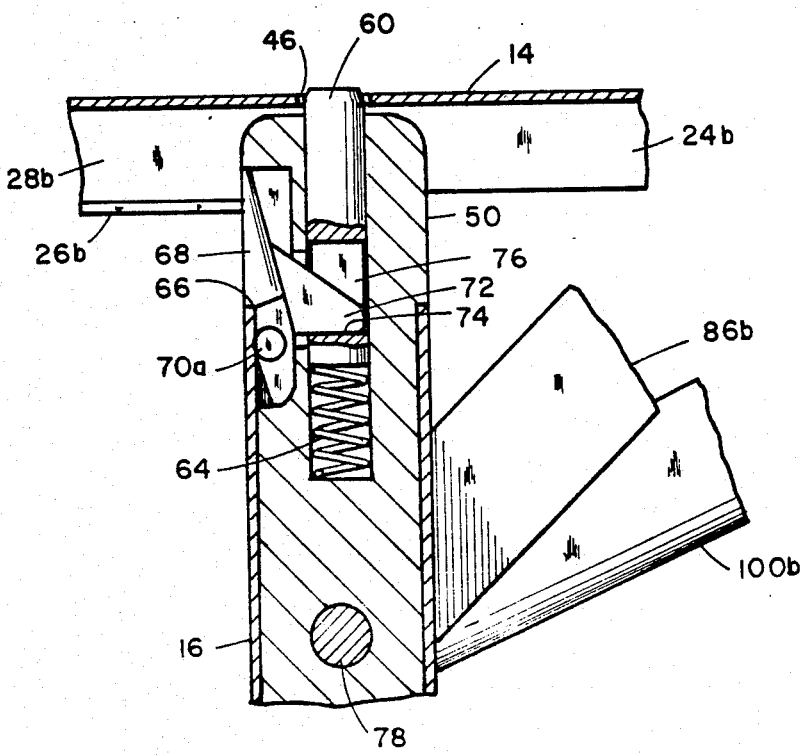
FIG. 7 is an enlarged cross-section, taken substantially along the line 7—7 of FIG. 4.

The diecast leg top 50 forms a housing within which is carried a locking pin 60. As shown in FIG. 7, the locking pin 60 protrudes through an opening in the leg top 50 to engage the locking hole 46 in the chassis 14 when the leg is erected. Locking pin 60 is biased outwardly by means of a spring 64. The side of the leg top 50 defines an arcuate opening 66 within which is mounted a locking pin actuator 68. Actuator 68 carries stub shafts 70*a,b* which are pivotally mounted in recesses (not shown) in the leg top 50. Extending inwardly from the actuator 68 is an arm 72 which engages a shoulder 74 formed by a recess 76 cut into the locking pin 60.

Spaced downwardly from the upper end of the leg top 50 and extending through the leg 16 is an axle 78. The ends of axle 78 extend outwardly on different sides of the leg 16. Over each end of the axle 78 is positioned a corresponding spacer grommet 80*a,b*. These grommets are essentially cylindrical but have their inner end surfaces 82*a,b* curved to fit the leg 16 and have planar outer end surfaces 84*a,b*. A tension link 86*a,b* is connected to each end of the axle 78 by means of a slot 88 in its end. Each of the tension links lies flat against the planar surface 84 of its corresponding grommet 80.

The opposite end of each tension link 86 is pivotally secured to a corresponding tension pivot tab 38*a,b* by means of a sheet metal bracket 90*a,b*. Each of these brackets has a base 92*a,b* positioned in the cutout opening 40 and secured to the table top by means of screws 94. The upright leaf 96*a,b* of each bracket is deformed so as to create a pivot pin 98*a,b* which extends through a pivot hole in the end of the corresponding tension link 86*a,b*.

Mounted to the extreme ends of the axle 78 are a pair of identical compression members 100*a,b*. As will be clear from FIG. 2, the compression members 100 are elongated. As befits a member intended to be in compression, each is relatively massive in cross-section, being of die-cast aluminum. Each is secured to the axle 78 by means of a drive pin 102*a,b*. The end of the corresponding tension link 86 is loosely secured between the end of the compression member 100 and the corresponding grommet 80. The opposite end of each compression member includes a boss 104*a,b*. Each boss is connected by a drive pin 106*a,b* to a pivot pin 108*a.,b* which is rotatably carried between the corresponding pivot bracket 34 and pivot tab 36.

OPERATION

Figure 9:
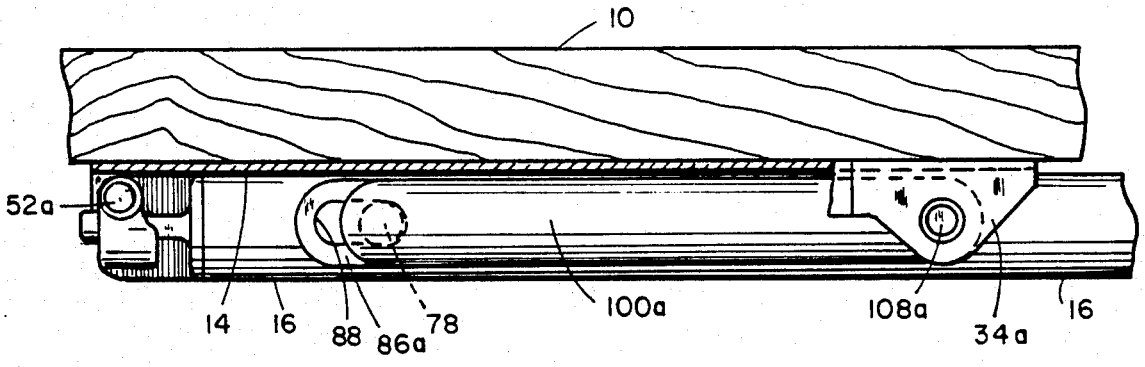
FIG. 9 is a view similar to that of FIG. 8, showing the mechanism in its fully folded condition.

The operation of the folding mechanism of this invention will now be explained, beginning with the mechanism in its folded position as illustrated in FIG. 9. In this position the leg 16 lies against the bottom of the table top 10. The plastic caps 52*a,b*, on the ends of the leg top 50 are positioned at the ends of their respective guide channels 28*a,b*. Both compression members 100*a,b* and both tension links 86*a,b* are also folded toward the chassis 14 with the axle 78 carried by the leg 16 positioned near one end of the slot 88 in each of the tension links 86*a,b*.

In order to erect the table, the bottom end of the leg 16 is pulled outwardly, away from the table top 10. As will be apparent from FIG. 8, the leg 16 pivots around the axle 78 which is secured at its ends to the compression members 100*a,b*. As the leg 16 pivots outwardly, the plastic caps 52*a,b* which are engaged within the guide channels 28*a,b* are retracted (to the right as viewed in FIG. 8) within their respective guide channels 28. At the same time, the axle 78 slides leftward within the slot 88 provided in each of the tension links 86*a,b*. This motion continues as the leg 16 is gradually staightened until the plastic caps 52*a,b* reach the far end of each of the guide channels 28*a,b* and near the respective stops 30*a,b* as shown in FIG. 2. At this point, several things take place.

Figure 8:
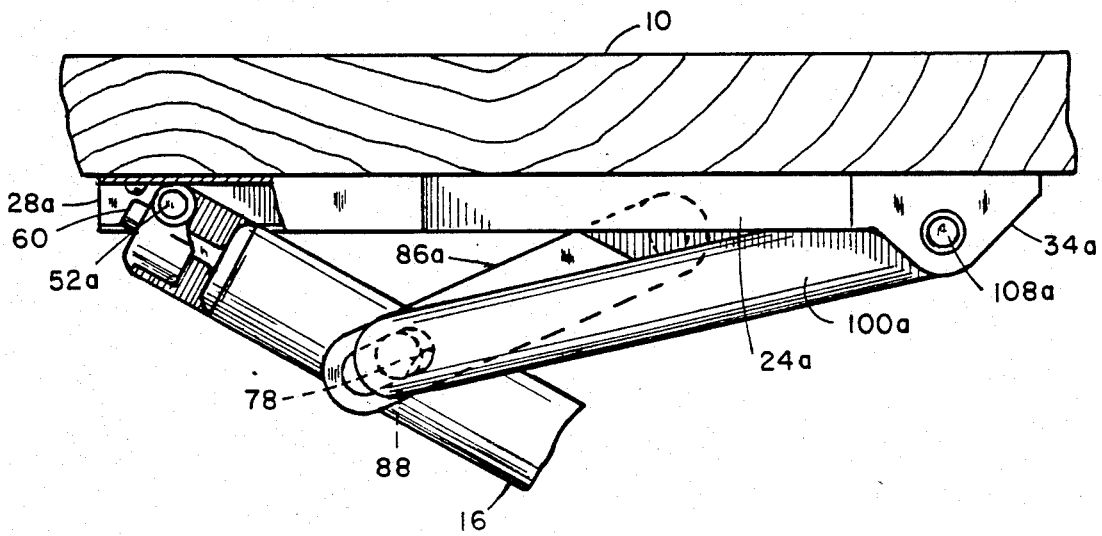
FIG. 8 is an elevational view similar to that of FIG. 3 but showing the mechanism in its partly folded condition.

As will be clear from FIGS. 7 and 8, the passage of the plastic caps 52*a,b* through their respective guide channels 28*a,b* causes the spring loaded locking pin 60 protruding from the leg top 50 to press against the chassis 14. This forces the locking pin downward against the force of the spring 64. As the leg 16 reaches its erected position, this locking pin 60 snaps through the locking hole 46 in chassis 14 under the influence of spring 64. At the same time, each of the resilient buttons 58 carried by the adjustable pressure bearings 56*a,b* is caused to snap into engagement between its respective pair 48*a,b* of locking ridges as illustrated in FIG. 5. Substantially simultaneously, the plastic caps 52*a,b* on the ends of the leg top 50 are forced against the respective stops 30*a,b* at the ends of the guide channels.

Most importantly, as the leg 16 is forced into its erected position as shown in FIG. 3., the axle 78 reaches the end of the slot 88 in each of the tension links 86*a,b*. The final locking positioning of leg 16 thereby puts the tension links 86*a,b* under tension. This tension force acting on the axle 78, the ends of which are secured to the compression members 100*a,b* puts the compression members into compression. It is this combination of tension members opposing compression members, which gives the erected table of this invention its exceptional rigidity. As will be apparent from FIG. 2, the tension links 86*a*, 86*b* are anchored by the use of four screws 44, 94 surrounding each of the tension pivot pins 98*a,b* to hold its bracket securely against the table top.

In order to fold the table, it is merely necessary to depress the lock pin actuator 68 shown in FIG. 7. As the actuator pivots about its stub shafts 70, the arm 72 presses downwardly on the shoulder 74 of the locking pin 60 causing it to retract against the force of spring 64. When the locking pin 60 clears the locking hole 46 in chassis 14 the leg 16 is pivoted about the axle 78. This causes the resilient buttons 58 on the adjustable pressure bearings 56 to snap out of engagement between their respective locking ridge pairs 48*a,b*. The plastic caps 52*a,b* are then guided down the guide channels 28*a,b* in the reverse order of erection, coming to rest in the position shown in FIG. 9. In this position the remote ends of the leg 16, which are not shown, may be held against the table top by a conventional latching device if desired.

One of the features of this invention is that the two adjustable pressure bearings 56*a,b*, which are threadedly engaged within the leg top 50, are provided with screw driver slots as illustrated in FIG. 2. As a result, any wear or looseness which may accumulate in the table mechanism over a period of time and use may be taken up by simply screwing these pressure bearings into tighter engagement between the respective locking ridge pairs 48*a,b*.

In the embodiment of the invention, described above, the tension members are described and illustrated as being solid links 86*a,b*. However, since these members are under tension when the table is erected, they need not necessarily be solid. They could, instead, be replaced by flexible members such as wires or chains. The important factor is that, when erected, they should be under tension and the tension forces should act directly to place the members 100 in compression. Accordingly, in the following claims, the term "link" is to be read as including flexible, as well as inflexible, tension members.

The described embodiment of this invention also includes a plate, or chassis 14, which serves as a base upon which the mechanical elements of the invention are formed, or otherwise carried. It will also be apparent, however, that such structure primarily serves the functions of convenience and efficiency. The separate elements of the invention such as the guide channels, the pivot brackets, etc. could be separately mounted directly to the table top. Accordingly, in the following claims, when an element is recited as being mounted on the table top, such expression is to be construed as including a structure as illustrated wherein one or more chassis plates, or their equivalents, are employed.

It will also be apparent that a number of other variations and modifications may be made in this invention without departing from its spirit and scope. Accordingly, the foregoing description is to be construed as illustrative only, rather than limiting. This invention is limited only by the scope of the following claims.

I claim:

1. In a table having a top and at least one leg having an upper end and a lower end and movable between a folded and an erected position by a folding mechanism on the underside of said top, the improvement in the folding mechanism which comprises:

a compression pivot member on said top having an axis of rotation parallel to the top;

first and second parallel guide tracks on said top perpendicular to the axis of rotation of said compression pivot member;

a tension link support member on said top;

first and second spaced guide members mounted to the upper end of said leg and engageable, respectively, with said first and second guide tracks for movement therealong;

at least one attachment member mounted said leg and spaced from its upper end;

an elongated compression member having a first end pivotally connected to said compression pivot member and a second end pivotally connected to said attachment member;

a tension link having a first end connected to said tension link support member and a second end connected to said attachment member;

the relative lengths of said tension link and said compression member being such that said link is in tension and said compression member is in compression when said leg is in its erected position; and means for releasably latching said leg in its erected position.

2. The improvement of claim 1 wherein said latching means comprises a spring-loaded pin on one of said table top and upper leg end and a pin engaging recess on the other of said table top and upper leg end.

3. The improvement of claim 2 wherein said pin is on the leg end and the recess is carried by the table top.

4. In a table having a top and at least one leg having an upper end and a lower end and movable between a folded and an erected position by a folding mechanism on the underside of said top, the improvement in the folding mechanism which comprises:

first and second spaced, coaxial, compression pivot members on said top having their common axis of rotation parallel to the top;

first and second parallel guide tracks on said top perpendicular to the axis of rotation of said compression pivot support members;

first and second tension link support members on said top;

first and second spaced guide members mounted to the upper end of said leg and engageable, respectively, with said first and second guide tracks for movement therealong;

at least one axle member positioned on said leg and spaced from its upper end, the longitudinal axis of said axle member being parallel to the common axis of said compression pivot members;

first and second elongated compression members, each having a first end pivotally connected to a different one of said first and second compression pivot members and a second end pivotally connected to said axle member;

first and second tension links, each having a first end connected to a different one of said tension link support members and a second end connected to said axle member;

said tension links and compression members being so dimensioned that, when said leg is in its erected position, each of said tension links is in tension and each of said compression members is in compression; and means for releasably latching said leg into its erected position.

5. The improvement of claim 4 wherein said latching means comprises a spring-loaded pin on one of said table top and upper leg end and a pin engaging recess on the other of said table top and upper leg end.

6. The improvement of claim 5 wherein said pin is mounted in the upper leg end and the recess is integral with the table top.

7. In a table having a substantially planar top and at least one leg having an upper end and a lower end and movable between a folded and an erected position, the improvement which comprises:

a plate mounted on the underside of said table top and defining first and second spaced, coaxial, compression pivot members and first and second parallel guide tracks perpendicular to the axis of said pivot members;

tension link supporting means on said plate;

first and second spaced guide members mounted to the upper end of said leg and engageable, respectively, with said first and second guide tracks for movement therealong:

first and second axially aligned pivots positioned on opposite sides of said leg and spaced from its upper end;

first and second elongated compression members, each having a first end pivotally connected to a respective one of said first and second compression pivot members and a second end pivotably connected to a respective one of said first and second pivots;

first and second tension links, each having a first end connected to said tension link support means and a second end connected to a respective one of said first and second pivots;

said tension links and said compression members being so dimensioned that, when said leg is in its erected position, said tension links are in tension and said compression members are in compression; and means for releasably latching said leg in its erected position.

8. The improvement of claim 7 wherein the upper end of said leg additionally includes adjustable pressure bearing means in engagement with said plate for increasing rigidity of the table when the leg is in the erected position.

9. The improvement of claim 8 wherein the adjustable pressure bearing means comprises an elastomeric pressure member threadedly engaged in said leg.

10. The improvement of claim 9 wherein the adjustable pressure bearing means further comprises a pair of locating ridges formed in said plate for receiving the pressure member therebetween.

11. The improvement of claim 10 wherein each of said tension link supporting means comprises a pivot bracket and each of said tension links comprises an arm pivoted at its first end to said pivot bracket and defining a slot at its second end receiving one of said first and second pivots.

12. The improvement of claim 11 wherein the upper end of the leg terminates in a T-shaped member, said first and second guide members comprise followers at the ends of the arms of the T and wherein said guide tracks comprise channels formed in said plate.

13. The improvement of claim 12 wherein at least one elastomeric pressure bearing means is carried by each arm of the T-shaped member.

* * * * *